US011691855B2

(12) United States Patent
Minami

(10) Patent No.: US 11,691,855 B2
(45) Date of Patent: Jul. 4, 2023

(54) CRANE

(71) Applicant: TADANO LTD., Kagawa (JP)

(72) Inventor: Yoshimasa Minami, Kagawa (JP)

(73) Assignee: TADANO LTD., Kagawa (JP)

( * ) Notice: Subject to any disclaimer, the term of this patent is extended or adjusted under 35 U.S.C. 154(b) by 235 days.

(21) Appl. No.: 17/256,539

(22) PCT Filed: Jul. 3, 2019

(86) PCT No.: PCT/JP2019/026477
§ 371 (c)(1),
(2) Date: Dec. 28, 2020

(87) PCT Pub. No.: WO2020/013054
PCT Pub. Date: Jan. 16, 2020

(65) Prior Publication Data

US 2021/0253405 A1 Aug. 19, 2021

(30) Foreign Application Priority Data

Jul. 11, 2018 (JP) ..... 2018-131738

(51) Int. Cl.
*B66C 13/40* (2006.01)
*B66C 13/46* (2006.01)
*B66C 23/88* (2006.01)

(52) U.S. Cl.
CPC ..... *B66C 13/40* (2013.01); *B66C 13/46* (2013.01); *B66C 23/88* (2013.01)

(58) Field of Classification Search
CPC ..... B66C 13/063; B66C 13/22; B66C 13/46; B66C 13/085; B66C 13/48; B66C 13/40;
(Continued)

(56) References Cited

U.S. PATENT DOCUMENTS 6,140,930 A * 10/2000 Shaw ..... B66C 13/46 340/685
2002/0175824 A1* 11/2002 Shaw ..... B66C 13/46 340/685
(Continued)

FOREIGN PATENT DOCUMENTS

EP 3766821 A1 1/2021
JP 2000-086159 A 3/2000
(Continued)

OTHER PUBLICATIONS

JP 2010/228905A Machine Translation (Year: 2010).*
(Continued)

*Primary Examiner* — Michael R Mansen
*Assistant Examiner* — Juan J Campos, Jr.
(74) *Attorney, Agent, or Firm* — Paratus Law Group, PLLC

(57) ABSTRACT

A crane is provided. A slewing base camera detects a load W that is suspended by a wire rope, the current coordinate location of the load is calculated from the location of the detected load, the current coordinate location of a tip end of a boom is calculated from the position of a crane, a target velocity signal that was inputted from a manipulation tool is converted into a target coordinate location of the load, a wire rope direction vector is calculated from the current coordinate location of the load and the target coordinate location of the load, a target location of the tip end of the boom for the target coordinate location of the load is calculated from a wire rope reel-out amount and the wire rope direction vector, and an actuator operation signal is generated.

4 Claims, 14 Drawing Sheets

(58) Field of Classification Search
CPC . B66C 13/44; B66C 23/88; B66F 9/20; B66F 9/24
See application file for complete search history.

(56) References Cited

U.S. PATENT DOCUMENTS

| | | | | |
|---|---|---|---|---|
| 2003/0214415 | A1* | 11/2003 | Shaw | B66C 15/06 340/685 |
| 2013/0013144 | A1* | 1/2013 | Tanizumi | B66C 23/905 701/34.4 |
| 2013/0103271 | A1* | 4/2013 | Best | B66C 13/40 701/50 |
| 2015/0217976 | A1* | 8/2015 | Tanizumi | B66C 13/00 703/2 |
| 2016/0119589 | A1* | 4/2016 | Tanizumi | H04N 23/635 345/173 |
| 2021/0039923 | A1 | 2/2021 | Minami | |

FOREIGN PATENT DOCUMENTS

| | | | |
|---|---|---|---|
| JP | 2008-074579 | A | 4/2008 |
| JP | 2010-228905 | A | 10/2010 |
| JP | 2016-013890 | A | 1/2016 |

OTHER PUBLICATIONS

Sep. 3, 2019, International Search Report issued for related PCT application No. PCT/JP2019/026477.

Sep. 3, 2019, International Search Opinion issued for related PCT application No. PCT/JP2019/026477.

May 24, 2021, Indian Examination Report issued for related IN application No. 202117000828.

Mar. 7, 2022, European Search Report issued for related EP Application No. 19834008.5.

* cited by examiner

CRANE

CROSS REFERENCE TO PRIOR APPLICATION

This application is a National Stage Patent Application of PCT International Patent Application No. PCT/JP2019/026477 (filed on Jul. 3, 2019) under 35 U.S.C. § 371, which claims priority to Japanese Patent Application No. 2018-131738 (filed on Jul. 11, 2018), which are all hereby incorporated by reference in their entirety.

TECHNICAL FIELD

The present invention relates to a crane including a monitoring apparatus.

BACKGROUND ART

Conventionally, as mobile cranes or the like, a crane including an obstacle alert system in order to enhance visibility of an obstacle during travelling or working has been proposed. The obstacle alert system is a system that detects whether or not there are obstacles, and approaches of persons, vehicles and the like, on the sides of the vehicle during travelling of the crane and within a working area during working, and gives an alert to an operator. The obstacle alert system is configured to detect an obstacle via a camera, a millimeter-wave radar or the like and display the detected state on a monitor or the like installed inside the cabin. For example, see Patent Literature (hereinafter abbreviated as PTL) 1.

The obstacle alert system described in PTL 1 includes, for example, a TV camera provided on a crane apparatus (boom support cover on a swivel base) of a crane, a display control section that performs processing for displaying a monitored image in real time, a monitor that displays the monitored image and an alert section that gives an alert to an operator (driver). The TV camera is provided to take an image of an area on the boom support cover side (opposite side across the boom), which is difficult for the operator inside the cabin to view. Consequently, the operator can more reliably recognize whether or not there is an obstacle by checking an area in which a field of view changes depending on the luffing angle of the boom on the monitor inside the cabin.

On the other hand, cranes in which each actuator is remotely manipulated by a remote manipulation terminal or the like have been proposed. As such cranes, a remote manipulation terminal and a crane that enable easy and simple manipulation of the crane by matching a manipulation direction of a manipulation tool of the remote manipulation terminal and an operation direction of the crane with each other irrespective of a relative positional relationship between the crane and the remote manipulation terminal have been known. For example, see PTL 2.

The crane described in PTL 2 is manipulated according to a manipulative command signal from a remote manipulation apparatus, the manipulative command signal being generated with reference to a load. In other words, actuators of the crane are controlled based on commands relating to a moving direction and a moving speed of the load, and thus, it is possible to intuitively manipulate the crane without paying attention to an operating speed, an operating amount, an operating timing and the like of each of the actuators. However, in the crane, at a start or stop of movement at which a speed signal from the remote manipulation apparatus is input in the form of a step function, discontinuous acceleration sometimes occurs, causing swinging of the load. Also, since the crane is controlled on the assumption that a load is always located vertically below a boom tip, it is impossible to prevent occurrence of a positional shift and/or swinging of the load caused by the influence of a wire rope.

CITATION LIST

Patent Literature

PTL 1
Japanese Patent Application Laid-Open No, 2016-13890
PTL 2
Japanese Patent Application Laid-Open No, 2010-228905

SUMMARY OF INVENTION

Technical Problem

An object of the present invention is to provide a crane and a crane control method that enable, when an actuator is controlled with reference to a load, moving the load along a target course while curbing swinging of the load.

Solution to Problem

The technical problem to be solved by the present invention has been stated above, and next, a solution to the problem will be explained.

At first aspect of the present invention is a crane including a monitoring apparatus provided in a crane apparatus, the monitoring apparatus monitoring a surrounding area, the crane including: a manipulation tool with which a target speed signal relating to a moving direction and a speed of a load is input; a swivel angle detection section for the boom; a luffing angle detection section for the boom; and an extension/retraction length detection section for the boom, in which the monitoring apparatus detects a load suspended by a wire rope, and a current position of the load relative to a reference position is computed from a position of the detected load, a current position of a boom tip relative to the reference position is computed from a swivel angle detected by the swivel angle detection section, the luffing angle detected by the luffing angle detection section and an extension/retraction length detected by the extension/retraction length detection section, the target speed signal input from the manipulation tool is converted into a target position of the load relative to the reference position, a let-out amount of the wire rope is computed from the current position of the load and the current position of the boom tip, a direction vector of the wire rope is computed from the current position of the load and the target position of the load, a target position of the boom tip for the target position of the load is computed from the let-out amount of the wire rope and the direction vector of the wire rope, and an operation signal for an actuator of the crane apparatus is generated based on the target position of the tip of the boom.

A second aspect of the present invention is the crane in which: a current speed of the load is computed from the position of the load detected by the monitoring apparatus; a target course signal is computed by integrating the target speed signal and attenuating a frequency component in a predetermined frequency range; a speed difference between the target speed signal and the current speed is computed; a corrected course signal is computed by multiplying the target course signal by a correction coefficient for reducing the speed difference; and the corrected course signal is converted into the target position of the load relative to the reference position.

A third aspect of the present invention is the crane, in which the monitoring apparatus includes a plurality of cameras, an image of the load is taken using the plurality of cameras as a stereo camera, and the current position of the load relative to the reference position is computed from the image taken by the plurality of cameras.

Advantageous Effects of Invention

The present invention produces effects as stated below.

In the first aspect of the invention, since a current position of a load is detected using the monitoring apparatus, a direction vector of the wire rope is computed from the current position and a target position of the load and a current position of the boom tip and a target position of the boom tip is computed from a let-out length and the direction vector of the wire rope, the boom is controlled such that the load is moved along a target course while the crane is manipulated with reference to the load. Consequently, it is possible to, when the actuator is controlled with reference to the load, move the load along the target course while curbing swinging of the load with high accuracy.

In the second aspect of the invention, since a current speed v(n) of the load is computed and a target speed signal of the load is corrected to reduce a difference between the target speed signal and the current speed v(n) of the load, accumulation of errors in the current position relative to the target course is curbed. Consequently, it is possible to, when the actuator is controlled with reference to the load, move the load along the target course while curbing swinging of the load with high accuracy.

In the third aspect of the invention, since a spatial position of the load is detected by the stereo camera configured using the plurality of cameras that monitor the area around the crane apparatus, a position and a speed of the load are computed with high accuracy. Consequently, it is possible to, when the actuator is controlled with reference to the load, move the load along the target course while curbing swinging of the load with high accuracy.

DESCRIPTION OF EMBODIMENTS

As a working vehicle according to an embodiment of the present invention, crane 1, which is a mobile crane (rough terrain crane), will be described below with reference to FIGS. 1 to 5. Note that although the present embodiment will be described in terms of crane 1 (rough terrain crane) as a working vehicle, the working vehicle may also be an all-terrain crane, a truck crane, a truck loader crane, an aerial work vehicle, or the like.

Figure 1:
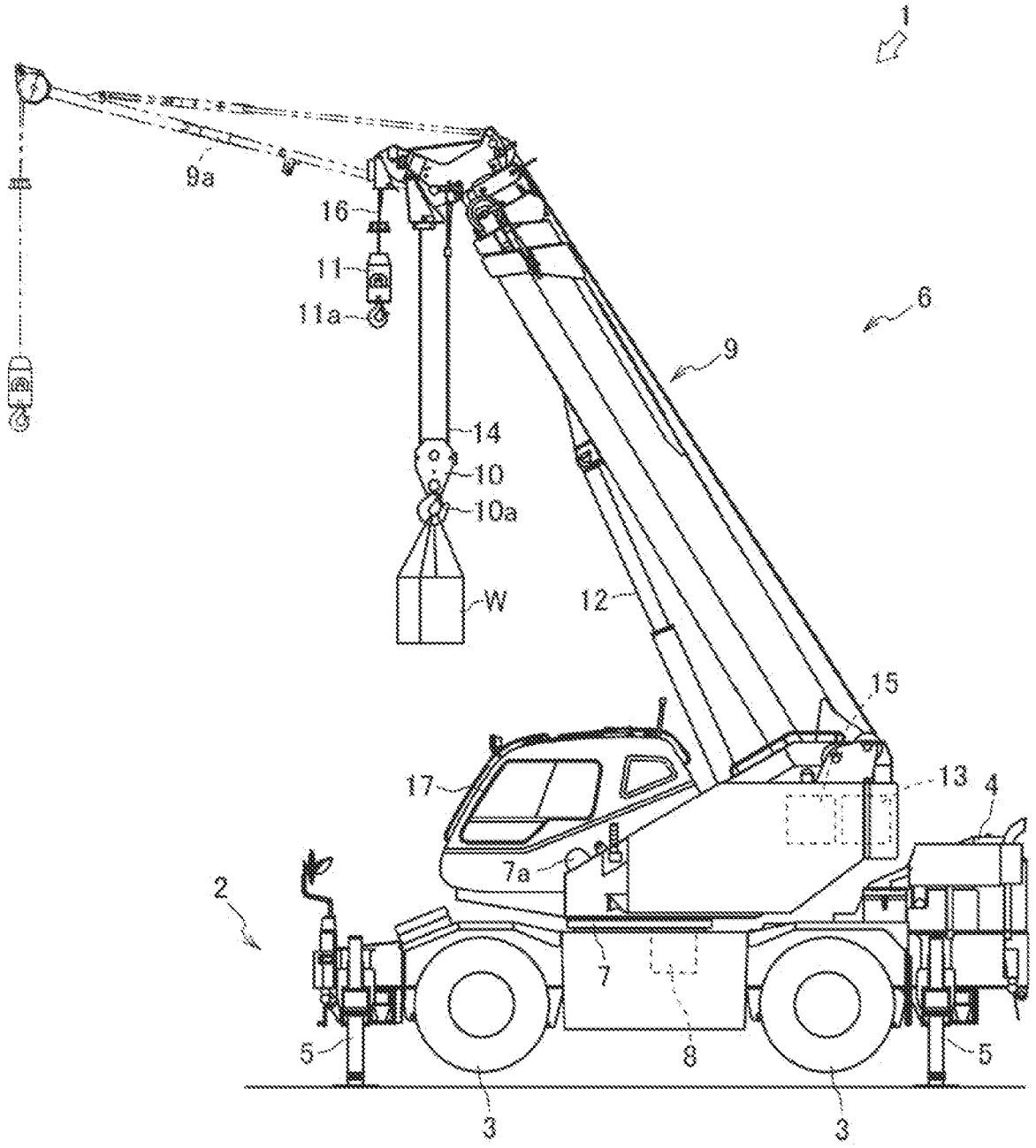
FIG. 1 is a side view illustrating an overall configuration of a crane.

As illustrated in FIG. 1, crane 1 is a mobile crane capable of moving to an unspecified place. Crane 1 includes vehicle 2 and crane apparatus 6, which is a working apparatus.

Vehicle 2 is a travelling body that carries crane apparatus 6. Vehicle 2 includes a plurality of wheels 3 and travels using engine 4 as a power source. Vehicle 2 is provided with outriggers 5. Outriggers 5 are composed of projecting beams hydraulically extendable on opposite sides in a width direction of vehicle 2 and hydraulic jack cylinders extendable in a direction perpendicular to the ground. Vehicle 2 can expand a workable region of crane 1 by extending outriggers 5 in the width direction of vehicle 2 and bringing the jack cylinders into contact with the ground.

Crane apparatus 6 is a working apparatus that hoists up load W with a wire rope. Crane apparatus 6 includes, for example, swivel base 7, swivel-base 7 cameras, boom 9, jib 9*a*, main hook block 10, sub hook block 11, hydraulic luffing cylinder 12, main winch 13, main wire rope 14, sub winch 15, sub wire rope 16, cabin 17, control apparatus 31 and a manipulation terminal.

Swivel base 7 is a swivel base that allows crane apparatus 6 to swivel. Swivel base 7 is disposed on a frame of vehicle 2 via an annular bearing. Swivel base 7 is configured to be rotatable with a center of the annular bearing as a rotational center. Swivel base 7 is provided with the plurality of swivel-base cameras 7*a* that monitor the surroundings. Also, swivel base 7 is provided with hydraulic swivel motor 8, which is an actuator. Swivel base 7 is configured to be capable of swiveling in one and other directions via hydraulic swivel motor 8.

Figure 2:
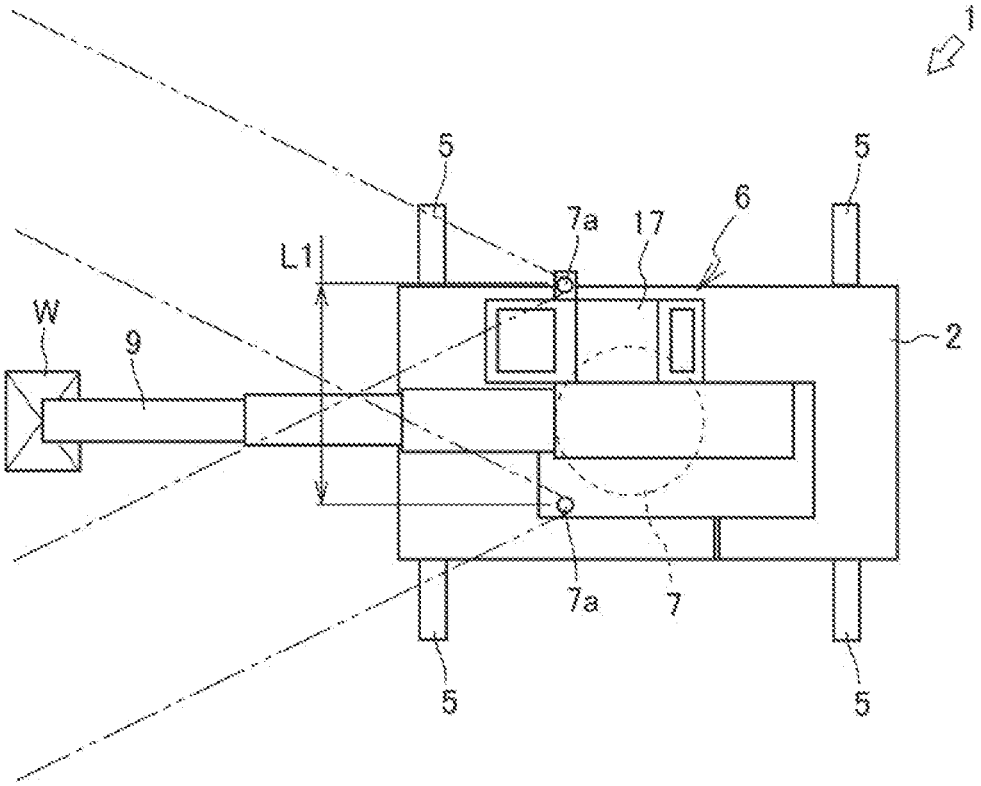
FIG. 2 is a plan view illustrating an overall configuration of the crane.

As illustrated in FIGS. 1 and 2, each of swivel-base cameras 7*a* is a monitoring apparatus that takes an image of, for example, obstacles and people around swivel base 7. Swivel-base cameras 7*a* are provided on opposite, left and right, sides of the front of swivel base 7 and opposite, left and right, sides of the rear of swivel base 7. The swivel-base cameras 7*a* take images of respective areas around places at which swivel-base cameras 7*a* are installed, to cover an entire area surrounding swivel base 7 as a monitoring area. Furthermore, swivel-base cameras 7*a* disposed on the opposite, left and right, sides of the front of swivel base 7 are configured to be usable as a stereo camera set. In other words, swivel-base cameras 7*a* on the opposite, left and right, sides of the front of swivel base 7 are used as a load position detection section that detects positional information of suspended load W as a three-dimensional coordinate value, by being used as a stereo camera set. In this case, crane 1 is configured so as to supplement an image taking range of swivel-base cameras 7*a* as a surrounding monitoring section, swivel-base cameras 7*a* being used as a stereo camera set, with another camera (for example, a boom camera), a sensor or the like. Note that the load position detection section may be composed of other cameras such as swivel-base cameras 7*a* provided at other positions and/or boom camera 9*b*. Also, the load position detection section only needs to be one that is capable of detecting current positional information of load W such as a millimeter-wave radar, a GNSS apparatus, or the like.

As illustrated in FIG. 1, hydraulic swivel motor 8, which is an actuator, is manipulated to rotate via swivel valve 23 (see FIG. 3), which is an electromagnetic proportional switching valve. Swivel valve 23 can control a flow rate of an operating oil supplied to hydraulic swivel motor 8 to any flow rate. In other words, swivel base 7 is configured to be controllable to have any swivel speed via hydraulic swivel motor 8 manipulated to rotate via swivel valve 23. Swivel base 7 is provided with swivel sensor 27 (see FIG. 3), which is a swivel angle detection section that detects swivel angle θz (angle) and swivel speed θz of swivel base 7.

Boom 9 is a movable boom that supports a wire rope such that load W can be hoisted. Boom 9 is composed of a plurality of boom members. In boom 9, a base end of a base boom member is swingably provided at a substantial center of swivel base 7. Boom 9 is configured to be capable being axially extended/retracted by moving the respective boom members with a non-illustrated hydraulic extension/retraction cylinder, which is an actuator. Also, boom 9 is provided with jib 9*a*.

The non-illustrated hydraulic extension/retraction cylinder, which is an actuator, is manipulated to extend and retract via extension/retraction valve 24 (see FIG. 3), which is electromagnetic proportional switching valve. Extension/retraction valve 24 can control a flow rate of an operating oil supplied to the hydraulic extension/retraction cylinder to any flow rate. Boom 9 is provided with extension/retraction sensor 28, which is an extension/retraction length detection section that detects a length of boom 9 and azimuth sensor 29 that detects an azimuth with a tip of boom 9 as a center.

Boom camera 9*b* (see FIG. 3), which is a sensing apparatus, is an image obtainment section that takes an image of load W and features around load W. Boom camera 9*b* is provided at a tip portion of boom 9. Boom camera 9*h* is configured to be capable of taking an image of load W, and features and geographical features around crane 1 from vertically above load W.

Main hook block 10 and sub hook block 11 are members for suspending load W. Main hook block 10 is provided with a plurality of hook sheaves around which main wire rope 14 is wound and main hook 10*a* for suspending load W. Sub hook block 11 is provided with sub hook 11*a* for suspending load W.

Hydraulic lulling cylinder 12 is an actuator that lulls up and down boom 9 and holds a posture of boom 9. In hydraulic lulling cylinder 12, an end portion of a cylinder part is swingably coupled to swivel base 7 and an end portion of a rod part is swingably coupled to the base boom member of boom 9. Hydraulic luffing cylinder 12 is manipulated to extend or retract via luffing valve 25 (see FIG. 3), which is an electromagnetic proportional switching valve. Luffing valve 25 can control a flow rate of an operating oil supplied to hydraulic lulling cylinder 12 to any flow rate. Boom 9 is provided with lulling sensor 30 (see FIG. 3), which is a luffing angle detection section that detects luffing angle θx.

Main winch 13 and sub winch 15 are actuators that pull in (wind) or let out (unwind) main wire rope 14 and sub wire rope 16. Main winch 13 is configured such that a main drum around which main wire rope 14 is wound is rotated by a non-illustrated main hydraulic motor, which is an actuator, and sub winch 15 is configured such that a sub drum around which sub wire rope 16 is wound is rotated by a non-illustrated sub hydraulic motor, which is an actuator.

The main hydraulic motor is manipulated to rotate via main valve 26*m* (see FIG. 3), which is an electromagnetic proportional switching valve. Main winch 13 is configured to be capable of being manipulated so as to have any pulling-in and letting-out speeds, by controlling the main hydraulic motor via main valve 26*m*. Likewise, sub winch 15 is configured to be capable of being manipulated so as to have any pulling-in and letting-out speeds, by controlling the sub hydraulic motor via sub valve 26*s* (see FIG. 3), which is an electromagnetic proportional switching valve. Main winch 13 and sub winch 15 are provided with winding sensors 43 (see FIG. 3) that detect let-out amounts 1 of main wire rope 14 and sub wire rope 16, respectively.

Cabin 17 is a housing that covers an operator compartment. Cabin 17 is mounted on swivel base 7. Cabin 17 is provided with a non-illustrated operator compartment. The operator compartment is provided with manipulation tools for manipulating vehicle 2 to travel, and swivel manipulation tool 18, luffing manipulation tool 19, extension/retraction manipulation tool 20, main drum manipulation tool 21*m*, sub drum manipulation tool 21*s* and manipulation terminal 32 and the like for manipulating crane apparatus 6 (see FIG. 3). Hydraulic swivel motor 8 is manipulatable with swivel manipulation tool 18. Hydraulic luffing cylinder 12 is manipulatable with luffing manipulation tool 19. The hydraulic extension/retraction cylinder is manipulatable with extension/retraction manipulation tool 20. The main hydraulic motor is manipulatable with main drum manipulation tool 21*m*. The sub hydraulic motor is manipulatable with sub drum manipulation tool 21*s*.

Figure 3:
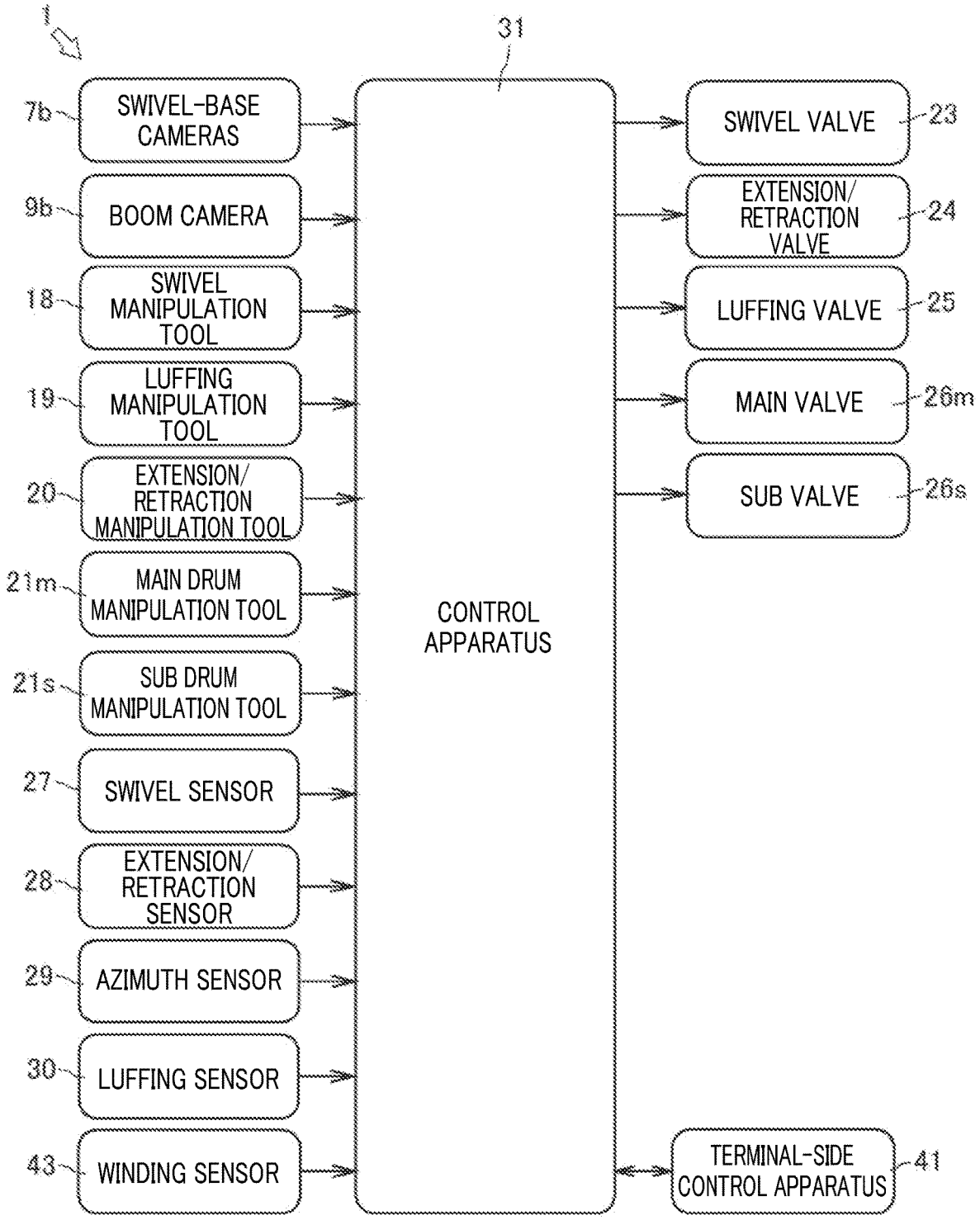
FIG. 3 is a block diagram illustrating a control configuration of the crane.

As illustrated in FIG. 3, control apparatus 31 controls the actuators of crane apparatus 6 via the manipulation valves. Control apparatus 31 is disposed inside cabin 17. Substantively, control apparatus 31 may have a configuration in which a CPU, a ROM, a RAM, an HDD and/or the like are connected to one another via a bus or may be composed of a one-chip LSI or the like. Control apparatus 31 stores various programs and/or data in order to control operation of the actuators, the switching valves, the sensors and/or the like.

Control apparatus 31 is connected to swivel-base cameras 7*a* and boom camera 9*b*, and is capable of obtaining image i1 from swivel-base cameras 7*a* and image i2 from boom camera 9*b*. Control apparatus 31 is also capable of computing current position coordinate p(n) of load W and a size of load W from obtained image i1 from swivel-base cameras 7*a*.

Control apparatus 31 are connected to swivel manipulation tool 18, luffing manipulation tool 19, extension/retraction manipulation tool 20, main drum manipulation tool 21*m* and sub drum manipulation tool 21*s*, and is capable of obtaining respective manipulation amounts of swivel manipulation tool 18, luffing manipulation tool 19, main drum manipulation tool 21*m* and sub drum manipulation tool 21*s*.

Control apparatus 31 is connected to terminal-side control apparatus 41 (see the figure) of manipulation terminal 32 and is capable of obtaining a control signal from manipulation terminal 32.

Control apparatus 31 is connected to swivel valve 23, extension/retraction valve 24, luffing valve 25, main valve 26*m* and sub valve 26*s*, and is capable of transmitting operation signals Md to swivel valve 23, luffing valve 25, main valve 26*m* and sub valve 26*s*.

Control apparatus 31 is connected to swivel sensor 27, extension/retraction sensor 28, azimuth sensor 29, tufting sensor 30 and winding sensor 43, and is capable of obtaining swivel angle θz of swivel base 7, extension/retraction length Lb, luffing angle θx, let-out amount l(n) of main wire rope 14 or sub wire rope 16 (hereinafter simply referred to as "wire rope") and an azimuth with the tip of boom 9 as a center.

Control apparatus 31 generates operation signals Md for swivel manipulation tool 18, fling manipulation tool 19, main drum manipulation tool 21*m* and sub drum manipulation tool 21*s* based on manipulation amounts of the respective manipulation tools.

Crane 1 configured as described above is capable of moving crane apparatus 6 to any position by causing vehicle 2 to travel. Crane 1 is also capable of increasing a lifting height and/or an operating radius of crane apparatus 6, for example, by luffing up boom 9 to any lifting angle θx with hydraulic lifting cylinder 12 by means of manipulation of tufting manipulation tool 19 and/or extending boom 9 to any length of boom 9 by means of manipulation of extension/retraction manipulation tool 20. Crane 1 is also capable of carrying load W by hoisting up load W with sub drum manipulation tool 21*s* and/or the like and causing swivel base 7 to swivel by means of manipulation of swivel manipulation tool 18.

Figure 4:
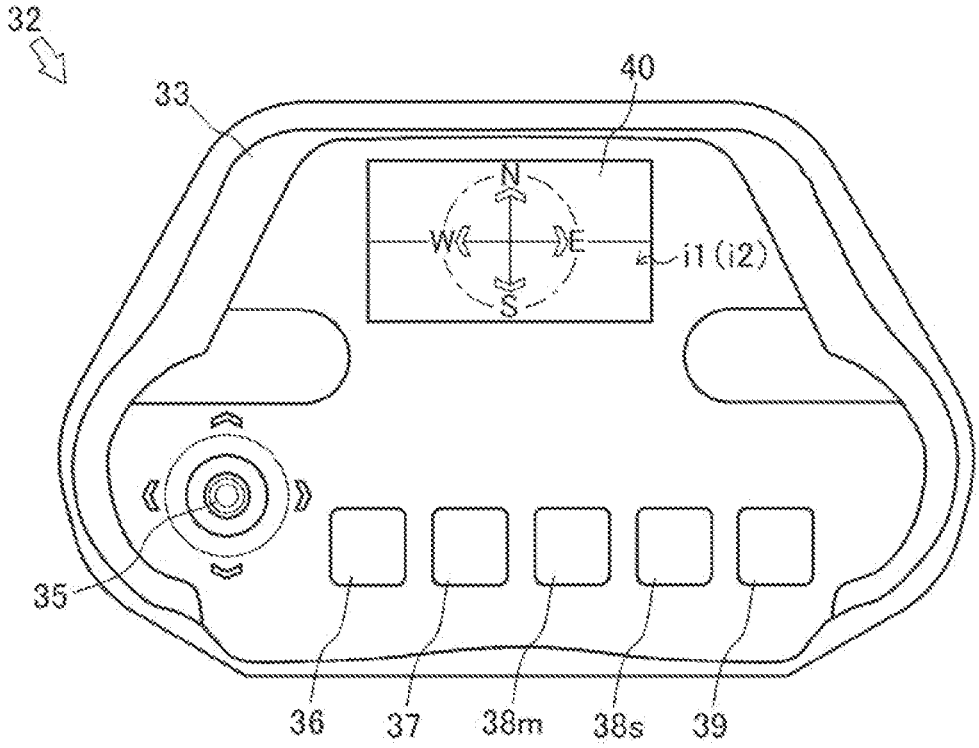
FIG. 4 is a plan view illustrating a schematic configuration of a manipulation terminal.
Figure 5:
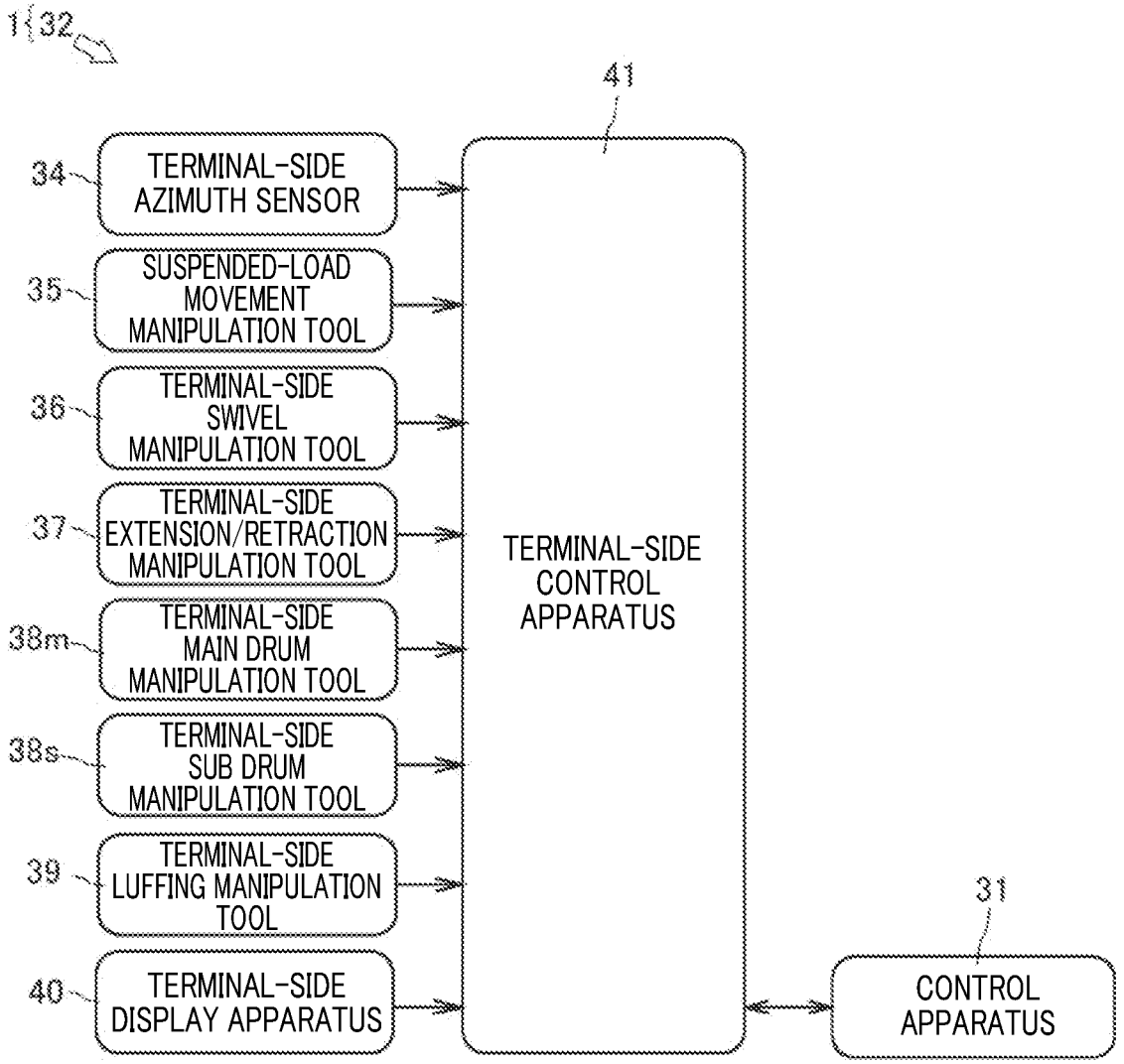
FIG. 5 is a block diagram illustrating a control configuration of the manipulation terminal.

As illustrated in FIGS. 4 and 5, manipulation terminal 32 is a terminal with which target speed signal Vd relating to a direction and a speed of movement of load W is input. Manipulation terminal 32 includes: for example; housing 33; suspended-load movement manipulation tool 35, terminal-side swivel manipulation tool 36, terminal-side extension/retraction manipulation tool 37, terminal-side main drum manipulation tool 38*m*, terminal-side sub drum manipulation tool 38*s*, terminal-side luffing manipulation tool 39 and terminal-side display apparatus 40 disposed on a manipulation surface of housing 33; and terminal-side control apparatus 41 (see FIGS. 3 and 5). Manipulation terminal 32 transmits target speed signal Vd of load W that is generated by manipulation of suspended-load movement manipulation tool 35 or any of the manipulation tools to control apparatus 31 of crane 1 (crane apparatus 6).

As illustrated in FIG. 4, housing 33 is a main component of manipulation terminal 32. Housing 33 is formed as a housing having a size that allows the operator to hold the housing with his/her hand. Suspended-load movement manipulation tool 35, terminal-side swivel manipulation tool 36, terminal-side extension/retraction manipulation tool 37, terminal-side main drum manipulation tool 38*m*, terminal-side sub drum manipulation tool 38*s*, terminal-side luffing manipulation tool 39 and terminal-side display apparatus 40 are installed on the manipulation surface of housing 33.

As illustrated in FIGS. 4 and 5, suspended-load movement manipulation tool 35 is a manipulation tool with which an instruction on a direction and a speed of movement of load W in a horizontal plane is input. Suspended-load movement manipulation tool 35 is composed of a manipulation stick erected substantially perpendicularly from the manipulation surface of housing 33 and a non-illustrated sensor that detects a tilt direction and a tilt amount of the manipulation stick. Suspended-load movement manipulation tool 35 is configured such that the manipulation stick can be manipulated to be tilted in any direction. Suspended-load movement manipulation tool 35 is configured to transmit a manipulation signal on the tilt direction and the tilt amount of the manipulation stick detected by the non-illustrated sensor with an upward direction in plan view of the manipulation surface (hereinafter simply referred to as "upward direction") as a direction of extension of boom 9, to terminal-side control apparatus 41.

Terminal-side swivel manipulation tool 36 is a manipulation tool with which an instruction on a swivel direction and a speed of crane apparatus 6 is input. Terminal-side extension/retraction manipulation tool 37 is a manipulation tool with which an instruction on extension/retraction and a speed of boom 9 is input. Terminal-side main drum manipulation tool 38*m* (terminal-side sub drum manipulation tool 38*s*) is a manipulation tool with which an instruction on a rotation direction and a speed of main winch 13 is input. Terminal-side luffing manipulation tool 39 is a manipulation tool with which an instruction on lulling and a speed of boom 9 is input. Each manipulation tool is composed of a manipulation stick substantially perpendicularly erected from the manipulation surface of housing 33 and a non-illustrated sensor that detects a tilt direction and a tilt amount of the manipulation stick. Each manipulation tool is configured to be tiltable to one side and the other side.

As illustrated in FIG. 5, terminal-side display apparatus 40 displays various kinds of information such as postural information of crane 1, information on load W and/or the like. Terminal-side display apparatus 40 is configured by an image display apparatus such as a liquid-crystal screen or the like. Terminal-side display apparatus 40 is provided on the manipulation surface of housing 33. Terminal-side display apparatus 40 displays an azimuth with the direction of extension of boom 9 as the upward direction in plan view of terminal-side display apparatus 40.

Terminal-side control apparatus 41, which is a control section, controls manipulation terminal 32. Terminal-side control apparatus 41 is disposed inside housing 33 of manipulation terminal 32. Substantively, terminal-side control apparatus 41 may have a configuration in which a CPU, a ROM, a. RAM an HDD and/or the like are connected to one another via a bus or may be composed of a one-chip LSI or the like. Terminal-side control apparatus 41 stores various programs and/or data in order to control operation of suspended-load movement manipulation tool 35, terminal-side swivel manipulation tool 36, terminal-side extension/retraction manipulation tool 37, terminal-side main drum manipulation tool 38*m*, terminal-side sub drum manipulation tool 38*s*, terminal-side luffing manipulation tool 39, terminal-side display apparatus 40 and/or the like.

Terminal-side control apparatus 41 is connected to suspended-load movement manipulation tool 35, terminal-side swivel manipulation tool 36, terminal-side extension/retraction manipulation tool 37, terminal-side main drum manipulation tool 38*m*, terminal-side sub drum manipulation tool 38*s* and terminal-side luffing manipulation tool 39, and is capable of obtaining manipulation signals each including a tilt direction and a tilt amount of the manipulation stick of the relevant manipulation tool.

Terminal-side control apparatus 41 is capable of generating target speed signal Vd of load W from manipulation signals of the respective sticks, the manipulation signals being obtained from the respective sensors of terminal-side swivel manipulation tool 36, terminal-side extension/retraction manipulation tool 37, terminal-side main drum manipulation tool 38*m*, terminal-side sub drum manipulation tool 38*s* and terminal-side luffing manipulation tool 39. Also, terminal-side control apparatus 41 is connected to control apparatus 31 of crane apparatus 6 wirelessly or via a wire, and is capable of transmitting generated target speed signal Vd of load W to control apparatus 31 of crane apparatus 6.

Next, control of crane apparatus 6 by manipulation terminal 32 will be described with reference to FIG. 6.

Figure 6:
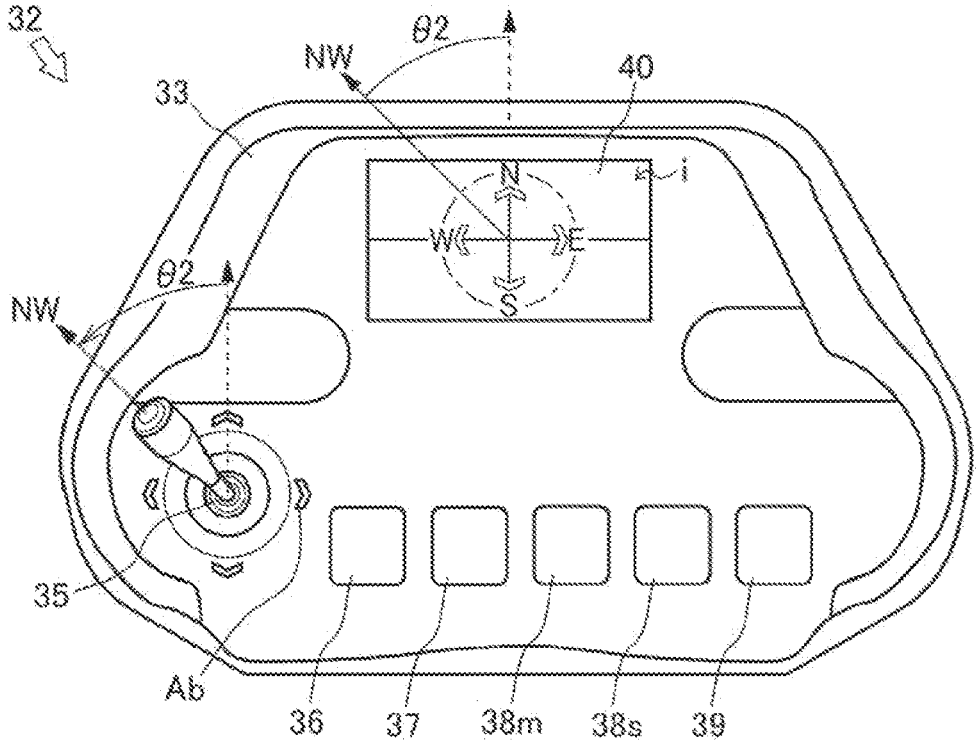
FIG. 6 illustrates an azimuth of a load carried in a case where a suspended-load movement manipulation tool is manipulated.

As illustrated in FIG. 6, when suspended-load movement manipulation tool 35 of manipulation terminal 32 is manipulated to be tilted leftward to a direction in which tilt angle θ2 is 45° relative to the upward direction by an arbitrary tilt amount in a state in which the tip of boom 9 faces north, terminal-side control apparatus 41 obtains a manipulation signal on a tilt direction and a tilt amount of a tilt to northwest, which is the direction in which tilt angle θ2 is 45°, from north, which is an extension direction of boom 9, from the non-illustrated sensor of suspended-load movement manipulation tool 35. Furthermore, terminal-side control apparatus 41 computes target speed signal Vd for moving load W to northwest at a speed according to the tilt amount from the obtained manipulation signal, every unit time t. Manipulation terminal 32 transmits computed target speed signal Vd to control apparatus 31 of crane apparatus 6 every unit time 1.

Upon receiving target speed signal Vd from manipulation terminal 32 every unit time t, control apparatus 31 computes target course signal Pd of load W based on an azimuth of the tip of boom 9, the azimuth being obtained from azimuth sensor 29. Furthermore, control apparatus 31 computes target position coordinate p(n+1) of load W, which is a target position of load W, from target course signal Pd. Control apparatus 31 generate respective operation signals Md for swivel valve 23, extension/retraction valve 24, lulling valve 25, main valve 26*m* and sub valve 26*s* to move load W to target position coordinate p(n+1) (see FIG. 7). Crane 1 moves load W toward northwest, which is the tilt direction of suspended-load movement manipulation tool 35, at a speed according to the tilt amount. In this case, crane 1 controls hydraulic swivel motor 8, a hydraulic extension/retraction cylinder, hydraulic tufting cylinder 12, the main hydraulic motor and/or the like based on the operation signals Md.

Crane 1 configured as described above obtains target speed signal Vd on a moving direction and a speed based on a direction of manipulation of suspended-load movement manipulation tool 35 with reference to the extension direction of boom 9, from manipulation terminal 32 every unit time and determines target position coordinate p(n+1) of load W, and prevents the operator from lose recognition of a direction of operation of crane apparatus 6 relative to a direction of manipulation of suspended-load movement manipulation tool 35. In other words, a direction of manipulation of suspended-load movement manipulation tool 35 and a direction of movement of load W are computed based on the extension direction of boom 9, which is a common reference. Consequently, it is possible to easily and simply manipulate crane apparatus 6. Note that although in the present embodiment, manipulation terminal 32 is provided inside cabin 17, but may be configured as a remote manipulation terminal that can remotely be manipulated from the outside of cabin 17, by providing a terminal-side wireless device.

Next, a first embodiment of a control process for computing target course signal Pd for load W, target course signal Pd being provided for generating operation signals Md, and target position coordinate q(n+1) of the tip of boom 9 in control apparatus 31 of crane apparatus 6 will be described with reference to FIGS. 7 to 12. Control apparatus 31 includes target course computation section 31*a*, boom position computation section 31*b* and operation signal generation section 31*c*. Also, control apparatus 31 is configured to be capable of obtaining current positional information of load W using the set of swivel-base cameras 7*a* on the opposite, left and right, sides of the front of swivel base 7 as a stereo camera, which is a load position detection section (see FIG. 2).

Figure 7:
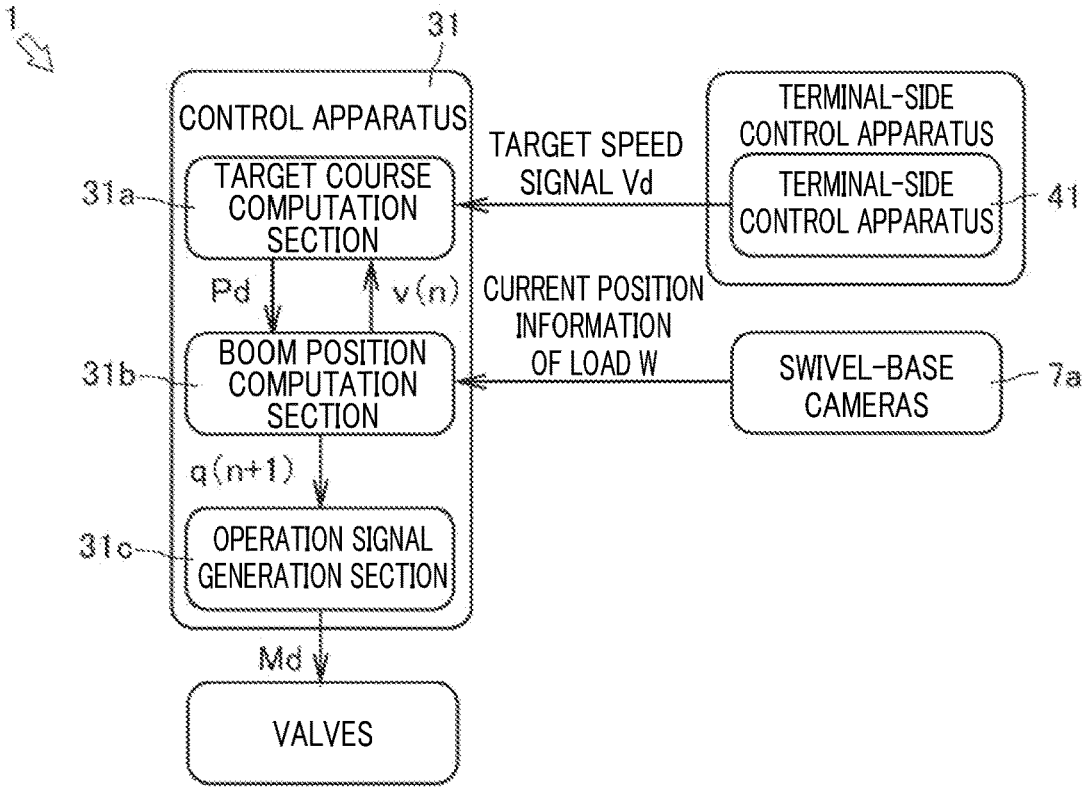
FIG. 7 is a block diagram illustrating a control configuration of a control apparatus of the crane.

As illustrated in FIG. 7, target course computation section 31*a* is a part of control apparatus 31 and converts target speed signal Vd for load W into target course signal Pd for load W. Target course computation section 31*a* can obtain target speed signal Vd for load W, which is composed of a moving direction and a speed of load W, from manipulation terminal 32 every unit time t. Also, target course computation section 31*a* can compute target positional information for load W by integrating obtained target speed signal Vd. Target course computation section 31*a* is also configured to apply low-pass filter Lp to the target positional information for load W to convert target positional information for load W into target course signal Pd, which is target positional information for load W, every unit time t.

Figure 8:
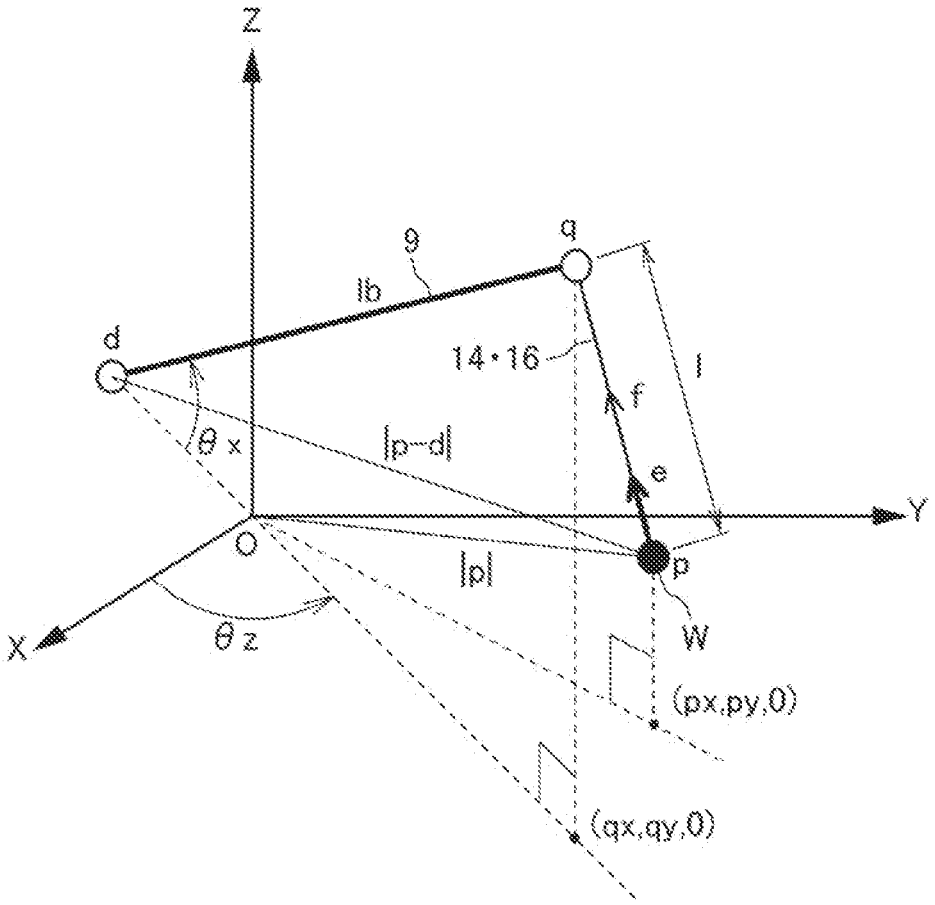
FIG. 8 is a diagram illustrating an inverse dynamics model of the crane.

As illustrated in FIGS. 7 and 8, boom position computation section 31*b* is a part of control apparatus 31 and computes a position coordinate of the tip of boom 9 from postural information of boom 9 and target course signal Pd for load W. Boom position computation section 31*b* can obtain target course signal Pd from target course computation section 31*a*. Boom position computation section 31*b* can obtain swivel angle θz(n) of swivel base 7 from swivel sensor 27, obtain extension/retraction length lb(n) from extension/retraction sensor 28, obtain luffing angle θx(n) from luffing sensor 30, obtain let-out amount l(*n*) of main wire rope 14 or sub wire rope 16 (hereinafter simply referred to as "wire rope") from winding sensor 43 and obtain current positional information of load W from an image of load W taken by the set of swivel-base cameras 7*a* disposed on the opposite, left and right, sides of the front of swivel base 7 (see FIG. 2).

Boom position computation section 31*b* can compute current position coordinate p(n) of load W from the obtained current positional information of load W and compute current position coordinate q(n) of the tip (position from which the wire rope is let out) of boom 9 (hereinafter simply referred to as "current position coordinate q(n) of boom 9"), which is a current position of the tip of boom 9, from obtained swivel angle θz(n), obtained extension/retraction length lb(n) and obtained luffing angle θx(n). Also, boom position computation section 31*b* can compute let-out amount l(n) of the wire rope from current position coordinate p(n) of load W and current position coordinate q(n) of boom 9. Furthermore, boom position computation section 31*b* can compute direction vector e(n+1) of the wire rope from which load W is suspended, from current position coordinate p(n) of load W and target position coordinate p(n+1) of load W, which is a position after a lapse of unit time t. Boom position computation section 31*b* is configured to compute target position coordinate q(n+1) of boom 9, which is a position of the tip of boom 9 after the lapse of unit time t, from target position coordinate p(n+1) of load W and direction vector e(n+1) of the wire rope, using inverse dynamics.

Operation signal generation section 31*c* is a part of control apparatus 31 and generates operation signals Md for the actuators from target position coordinate q(n+1) of boom 9 after the lapse of unit time t. Operation signal generation section 31*c* can obtain target position coordinate q(1+1) of boom 9 after the lapse of unit time t from boom position computation section 31*b*. Operation signal generation section 31*c* is configured to generate operation signals Md for swivel valve 23, extension/retraction valve 24, luffing valve 25, and main valve 26*m* or sub valve 26*s*.

Next, as illustrated in FIG. 8, control apparatus 31 determines an inverse dynamics model for crane 1 in order to compute target position coordinate q(n+1) of the tip of boom 9. The inverse dynamics model is defined on a XYZ coordinate system and origin O is a center of swivel of crane 1. Control apparatus 31 defines q, p, lb, θx, θz, l, f and e, respectively, in the inverse dynamics model. The sign q denotes, for example, current position coordinate q(n) of the tip of boom 9 and p denotes, for example, current position coordinate p(n) of load W. The sign lb denotes, for example, extension/retraction length lb(n) of boom 9 and θx denotes, for example, luffing angle θx(n), and θz denotes, for example, swivel angle θz(n). The sign 1 denotes, for example, let-out amount l(n) of the wire rope, f denotes tension f of the wire rope, and e denotes, for example, direction vector e(n) of the wire rope.

In the inverse dynamics model defined as described above, a relationship between target position q of the tip of boom 9 and target position p of load W is represented by Expression 1 using target position p of load W, mass m of load W and spring constant kf of the wire rope, and target position q of the tip of boom 9 is computed according to Expression 2, which is a function of time for load W.

[1]

$$m\ddot{p}=mg+f=mg+k_f(q-p) \tag{1}$$

(Expression 1)

and

[2]

$$q(t)=p(t)+I(t,\alpha)e(t)=q(p(t),\ddot{p}(t),\alpha) \tag{2}$$

(Expression 2)

wherein f is a tension of wire rope, kf is a spring constant, m is a mass of load W, q is a current position or target position of the tip of boom 9, p is a current position or target position of load W, l is a let-out amount of the wire rope, e is a direction vector and g is a gravitational acceleration.

Low-pass filter Lp attenuates frequencies that are equal to or higher than a predetermined frequency. Target course computation section 31*a* prevents occurrence of a singular point (abrupt positional change) caused by a differential operation, by applying low-pass filter Lp to target speed signal Vd. Although in the present embodiment, for low-pass filter Lp, fourth-order low-pass filter Lp is used to deal with a fourth-order differentiation in computation of spring constant kf, low-pass filter Lp of an order according to desired characteristics can be employed. Each of a and b in Expression 3 is a coefficient.

(Expression 3)

$$G(s)=\frac{a}{(s+b)^4} \tag{3}$$

Let-out amount l(n) of the wire rope is computed according to Expression 4 below.

Let-out amount l(n) of the wire rope is defined by a distance between current position coordinate q(n) of boom 9, which is a position of the tip of boom 9, and current position coordinate p(n) of load W, which is a position of load W.

[4]

$$I(n)^2=|q(n)-p(n)|^2 \tag{4}$$

(Expression 4)

Direction vector e(n) of the wire rope is computed according to Expression 5 below.

Direction vector e(n) of the wire rope is a vector of tension f (see Expression 1) of the wire rope for a unit length. Tension f of the wire rope is computed by subtracting the gravitational acceleration from an acceleration of load W, the acceleration being computed from current position coordinate p(n) of load W and target position coordinate p(n+1) of load W after the lapse of unit time t.

(Expression 5)

$$e(n)=\frac{f}{|f|}=\frac{\ddot{p}(n)-g}{|\ddot{p}(n)-g|} \tag{5}$$

Target position coordinate q(n+1) of boom 9, which is a target position of the tip of boom 9 after the lapse of unit time t, is computed from Expression 6 representing Expression 1 as a function of n. Here, α denotes swivel angle θz(n) of boom 9.

Target position coordinate q(n+1) of boom 9 is computed from let-out amount (n) of the wire rope, target position coordinate p(n+1) of load W and direction vector e(n+1) using inverse dynamics.

[6]

$$q(n+1)=p(n+1)+I(n,\alpha)e(t+1)=q(p(n+1),\ddot{p}(n+1),\alpha) \tag{6}$$

(Expression 6)

Next, a control process for computation of target course signal Pd for load W and computation of target position coordinate q(n+1) of the tip of boom 9 in order to generate operation signals Md in control apparatus 31 will be described in detail with reference to FIGS. 9 to 12.

Figure 9:
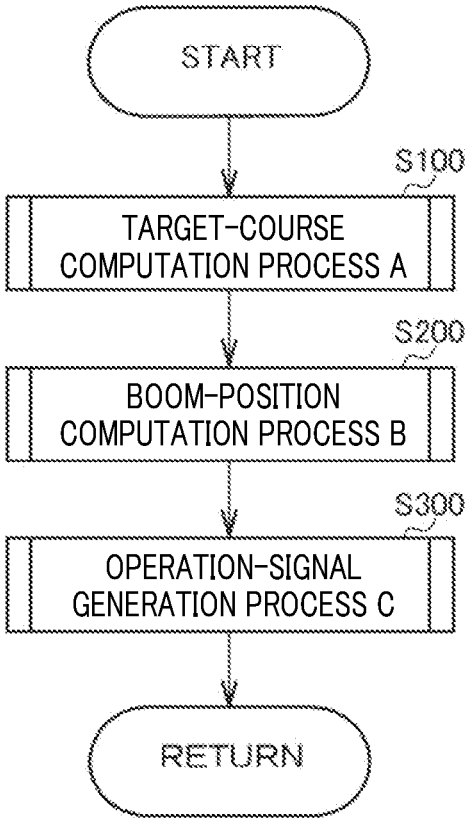
FIG. 9 is a flowchart illustrating a control process in a method of controlling the crane.
Figure 10:
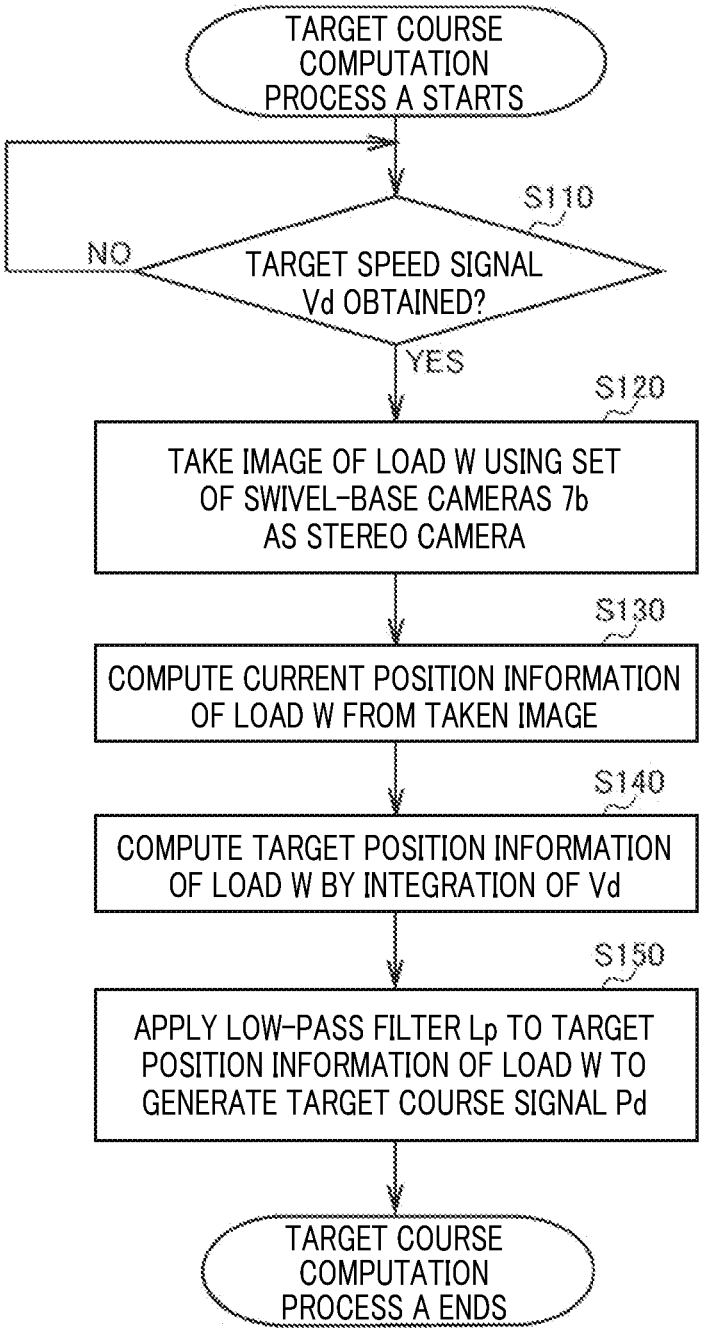
FIG. 10 is a flowchart illustrating a target-course computation process.

As illustrated in FIG. 9, in S100, control apparatus 31 starts target-course computation process A in a method for controlling crane 1 and makes the control proceed to step S110 (see FIG. 10). Then, upon completion of target-course computation process A, the control proceeds to step S200 (see FIG. 9).

Figure 11:
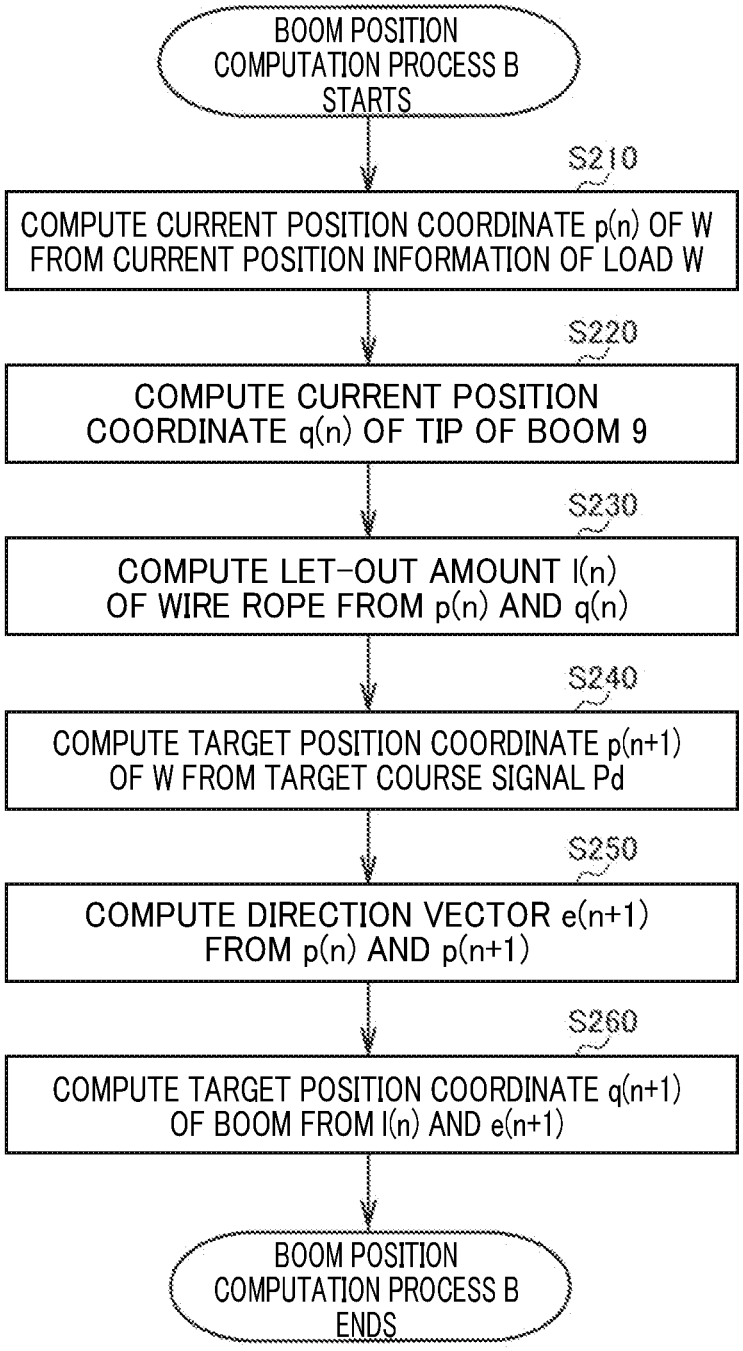
FIG. 11 is a flowchart illustrating a boom-position computation process.

In step 200, control apparatus 31 starts boom-position computation process B in the method for controlling crane 1, and makes the control proceed to step S210 (see FIG. 11). Then, upon completion of boom-position computation process B, the control proceeds to step S300 (see FIG. 9).

Figure 12:
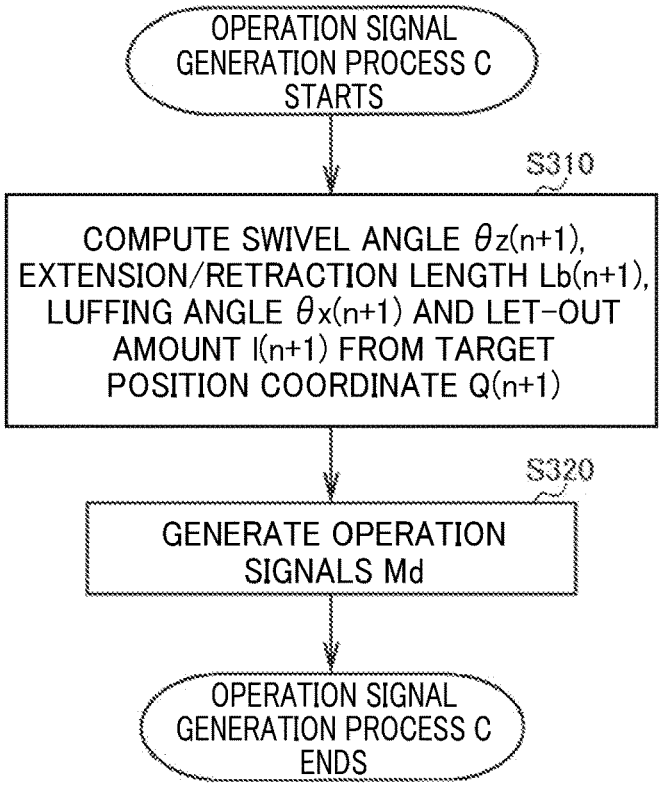
FIG. 12 is a flowchart illustrating an operation-signal generation process.

In step 300, control apparatus 31 starts operation-signal generation process C in the method for controlling crane 1, and makes the control proceed to step S310 (see FIG. 12). Then, upon completion of operation-signal generation process C, the control proceeds to step S100 (see FIG. 9).

As illustrated in FIG. 10, in step S110, target course computation section 31*a* of control apparatus 31 determines whether or not target speed signal Vd for load W is obtained.

As a result, if target speed signal Vd for load W is obtained, target course computation section 31*a* makes the control proceed to S120.

On the other hand, if target speed signal Vd for load W is not obtained, target course computation section 31*a* makes the control proceed to S110.

In step S120, boom position computation section 31*b* of control apparatus 31 causes an image of load W to be taken using the set of swivel-base cameras 7*a* on the opposite, left and right, sides of the front of swivel base 7 as a stereo camera, and makes the control proceed to step S130.

In step S130, boom position computation section 31*b* computes current positional information of load W from the image taken by the set of swivel-base cameras 7*a*, and makes the control proceed to step S140.

In step S140, target course computation section 31*a* computes target positional information of load W by integrating obtained target speed signal Vd for load W, and makes the control proceed to step S150.

In step S150, target course computation section 31*a* computes target course signal Pd every unit time t by applying low-pass filter Lp, which is indicated by transfer function G(s) in Expression 3, to the computed target positional information of load W. and ends target-course computation process A and makes the control proceed to step S200 (see FIG. 9).

As illustrated in FIG. 11, in step S210, boom position computation section 31*b* of control apparatus 31 computes current position coordinate p(n) of load W, which is a current position of load W, from the obtained current positional information of load W, using an arbitrarily determined position, for example, origin O, which is a center of swivel of boom 9, as reference position O, and makes the control proceed to step S220.

In step S220, boom position computation section 31*b* computes current position coordinate q(n) of the tip of boom 9 from obtained swivel angle θz(n) of swivel base 7, obtained extension/retraction length lb(n) and obtained luffing angle θx(n) of boom 9, and makes the control proceed to step S230.

In step S230, boom position computation section 31*b* computes let-out amount l(n) of the wire rope from current position coordinate p(n) of load W and current position coordinate q(n) of boom 9 using Expression 4 above, and makes the control proceed to step S240.

In step S240, boom position computation section 31*b* computes target position coordinate p(n+1) of load W, which is a target position of load W after a lapse of unit time t, from target course signal Pd with reference to current position coordinate p(n) of load W. and makes the control proceed to step S250.

In step S250, boom position computation section 31*b* computes an acceleration of load W from current position coordinate p(n) of load W and target position coordinate p(n+1) of load W, and computes direction vector e(n+1) of the wire rope according to Expression 5 above using the gravitational acceleration, and makes the control proceed to step S260.

In step S260, boom position computation section 31*b* computes target position coordinate q(n+1) of boom 9 from computed let-out amount l(n) of the wire rope and computed direction vector e(n+1) of the wire rope using Expression 6 above, and ends boom-position computation process B and makes the control proceed to step S300 (see FIG. 9).

As illustrated in FIG. 12, in step S310, operation signal generation section 31*c* of control apparatus 31 computes swivel angle θz(n+1) of swivel base 7, extension/retraction length Lb(n+1), luffing angle θx(n+1) and let-out amount l(n+1) of the wire rope after the lapse of unit time t from target position coordinate q(n+1) of boom 9, and makes the control proceed to step S320.

In step S320, operation signal generation section 31*c* generates respective operation signals Md for swivel valve 23, extension/retraction valve 24, luffing valve 25 and main valve 26*m* or sub valve 26*s* from computed swivel angle θz(n+1) of swivel base 7, computed extension/retraction length Lb(n+1), computed luffing angle θx(n+1) and computed let-out amount l(n+1) of the wire rope, and ends the operation-signal generation process C and makes the control proceed to step S100 (see FIG. 9).

Control apparatus 31 computes target position coordinate q(n+1) of boom 9 by repeating target-course computation process A, boom-position computation process B and operation-signal generation process C. and after a lapse of unit time t, computes direction vector e(n+2) of the wire rope from let-out amount l(n+1) of the wire rope, current position coordinate p(n+1) of load W and target position coordinate p(n+2) of load W, and computes target position coordinate q(n+2) of boom 9 after a further lapse of unit time t from let-out amount l(n+1) of the wire rope and direction vector e(n+2) of the wire rope. In other words, control apparatus 31 computes direction vector e(n) of the wire rope and sequentially computes target position coordinate q(n+1) of boom 9 after a lapse of unit time t from current position coordinate p(n+1) of load W, target position coordinate p(n+1) of load W and direction vector e(n) of the wire rope using inverse dynamics. Control apparatus 31 controls the actuators based on target position coordinate q(n+1) of boom 9 by means of feedforward control for generating operation signals Md.

Control apparatus 31 is also capable of displaying a distance from reference position O to load W on a horizontal plane and a distance (height) from a bottom surface of load W to the ground on the terminal-side display apparatus 40 or the like, based on current position coordinate p(n) of load W. In other words, control apparatus 31 is capable of objectively indicating a rough distance from the operator compartment inside cabin 17 to load W and a distance from the ground to the bottom surface of load W in figures. At this time, if there is a load within an arbitrarily designated range from reference position O or at a height that is equal to or lower than an arbitrarily designated height from the ground, control apparatus 31 provides notification to the operator by emphasizing the indication of the relevant distance or giving a warning.

Also, in the present embodiment, crane 1 may have a function that detects an obstacle from an image taken by swivel-base cameras 7*a*. If an obstacle on the course is detected by image recognition, control apparatus 31 controls the actuators to prevent contact between load W and the obstacle. For example, control apparatus 31 generates operation signals Md for stopping load W while curbing swinging of load W, to control the valves of the actuators. Alternatively, control apparatus 31 generates target course signal Pd for load W for avoiding the obstacle based on predetermined conditions. Control apparatus 31 can determine margin time by estimating time before a collision between the obstacle and load W from a velocity vector computed based on current position coordinate p(n) of load W in the image taken by swivel-base cameras 7*a* and target position coordinate p(n+1) of load W.

Crane 1 configured as described above computes target course signal Pd based on target speed signal Vd for load W, target speed signal Vd being arbitrarily input from manipulation terminal 32, and thus, is not limited to a prescribed speed pattern. Also, for crane 1, feedforward control in which a control signal for boom 9 is generated with reference to load W and a control signal for boom 9 is generated based on a target course intended by the operator is employed. Therefore, in crane 1, a delay in response to a manipulation signal is small and swinging of load W due to the delay in response is curbed. Also, an inverse dynamics model is built and target position coordinate q(n+1) of boom 9 is computed from current position coordinate p(n) of load W, current position coordinate p(n) being measured using swivel-base cameras 7*a*, direction vector e(n) of the wire rope and the target position coordinate p(n+1) of load W, enabling curbing an error. Furthermore, frequency components including singular points generated by a differential operation in computation of target position coordinate q(n+1) of boom 9 are attenuated, and thus, control of boom 9 is stabilized. Also, in crane 1, in order to prevent load W from colliding with the ground, features, crane 1 and the like, current position coordinate p(n) of load W is numerically indicated on terminal-side display apparatus 40 or the like. Consequently, crane 1 enables, when the actuators are controlled with reference to load W, moving load W along a target course while curbing swinging of load W with high accuracy.

Next, correction of target speed signal Vd in control apparatus 31 of crane apparatus 6 will be described with reference to FIG. 13 and FIG. 14. It is assumed that control apparatus 31 is capable of obtaining current speed information of load W from an image taken by a set of swivel-base cameras 7*a* used as a stereo camera. Note that correction of target speed signal Vd according to the below embodiment is employed in place of control for curbing swinging of a non-used hook in crane 1 and the control process illustrated in FIGS. 1 to 12, and thus, names, figure numbers and reference numerals used in the description thereof are used to indicate those that are the same as above, and in the below embodiment, specific description of points that are similar to those of the embodiments described above is omitted and differences from the embodiments described above will mainly be described.

Figure 13:
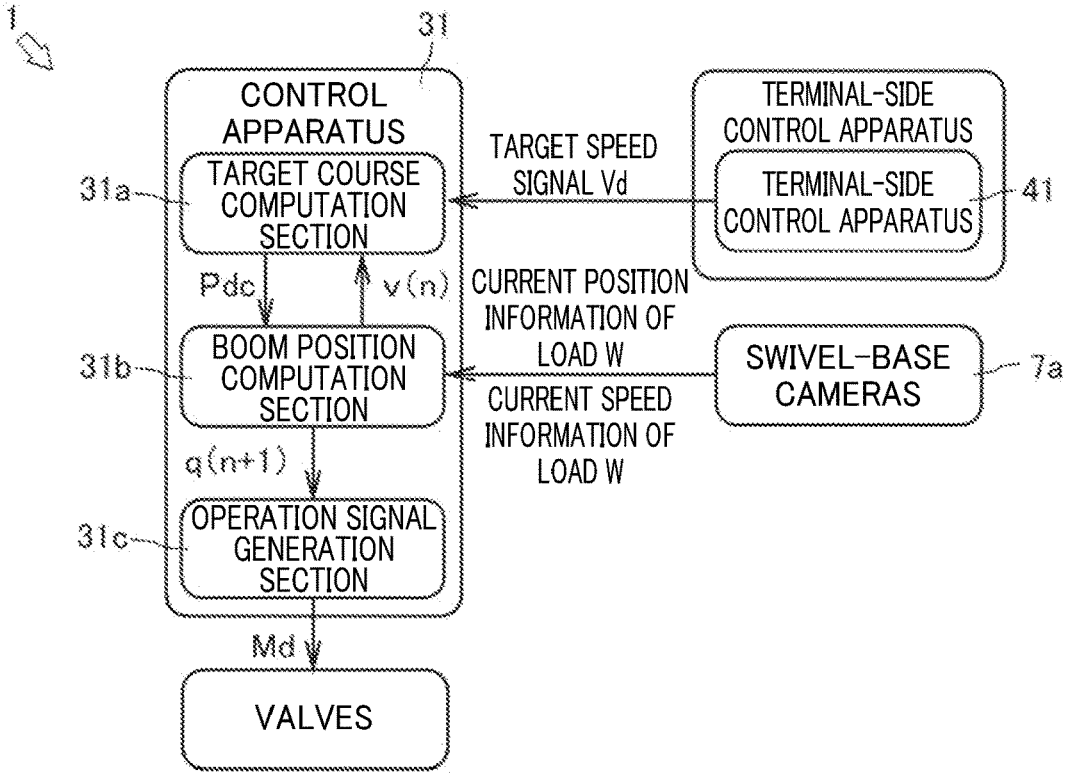
FIG. 13 is a block diagram illustrating a control configuration in which a target course signal is corrected in the control apparatus of the crane.

As illustrated in FIG. 13, target course computation section 31*a* is capable of obtaining current speed v(n) of load W from boom position computation section 31*b* every unit time t. Target course computation section 31*a* is also capable of computing a speed difference between obtained current speed v(n) of load W and target speed signal Vd of load W, the target speed signal Vd being obtained from manipulation terminal 32, every unit time t. Target course computation section 31*a* is also capable of computing corrected course signal Pdc every unit time t by multiplying computed target course signal Pd by correction coefficient Gn for reducing the speed difference. Correction coefficient Gn indicates a gain of target speed signal Vd. For target course computation section 31*a*, correction coefficient Gn by which target course signal Pd is multiplied is prescribed according to the speed difference.

Boom position computation section 31*b* is capable of obtaining current speed information of load W from an image of load W taken by a set of swivel-base cameras 7*a*. Furthermore, boom position computation section 31*b* is capable of computing current speed V(n) of load W from obtained current speed information of load W.

Figure 14:
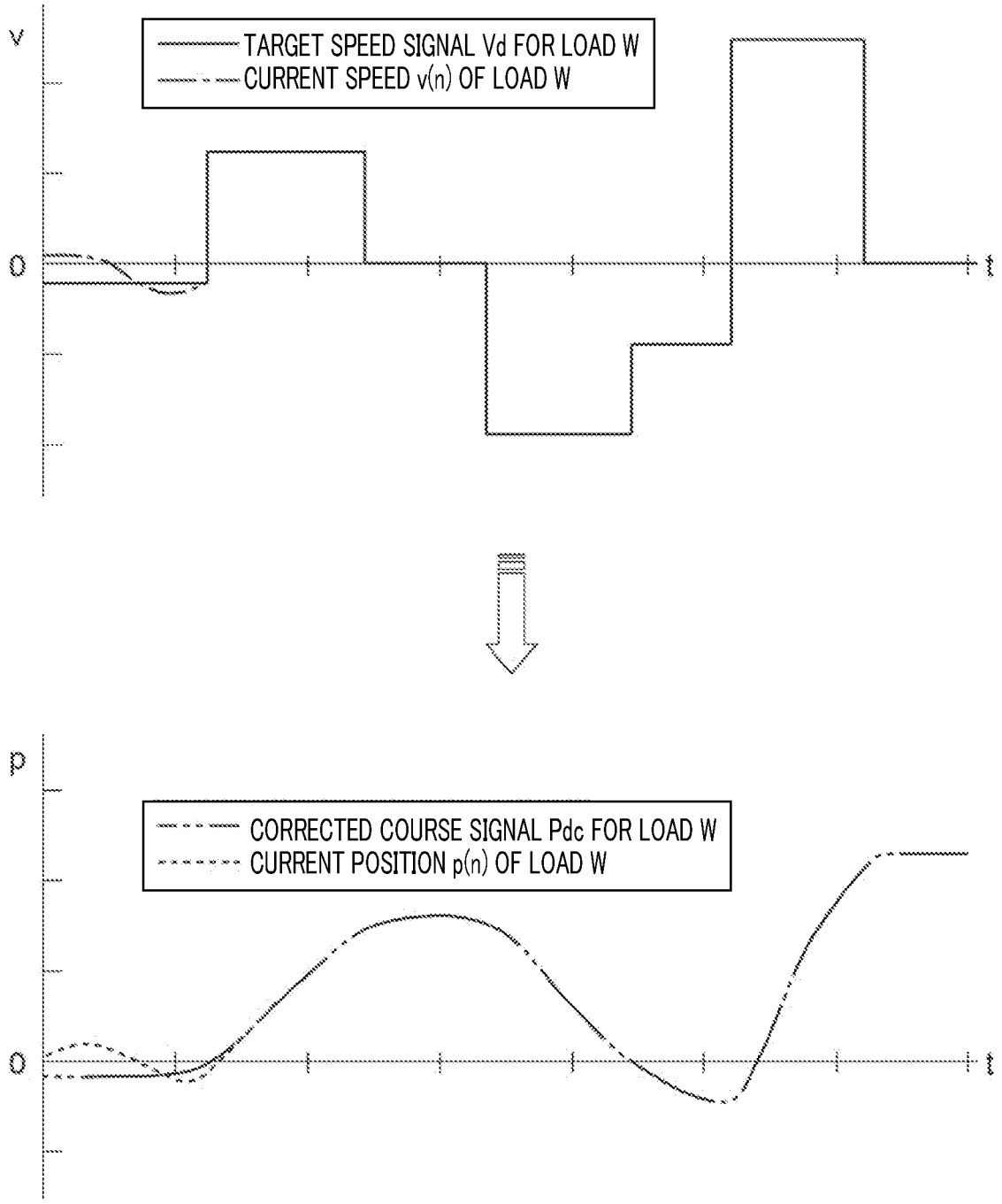
FIG. 14 is a graph illustrating a relationship between a target speed signal and the target course signal.

As illustrated in FIG. 14, control apparatus 31 determines correction coefficient Gn according to the speed difference between current speed v(n) (alternate long and short dash line in the figure) and target speed signal Vd (solid line in the figure) of load W, the speed difference being obtained by target course computation section 31*a*. Then, control apparatus 31 computes corrected course signal Pdc by multiplying already computed target course signal Pd (alternate long and two short dashes line in the figure) by correction coefficient Gn. For example, where current speed v(n) is higher than target speed signal Vd, control apparatus 31 multiplies target course signal Pd by correction coefficient Gn for increasing target speed signal Vd.

Next, a control process for computation of corrected course signal Pdc of load W and computation of target position coordinate q(n+1) of a tip of boom 9 to generate operation signals Md in control apparatus 31 will be described in detail with reference to FIG. 15.

Figure 15:
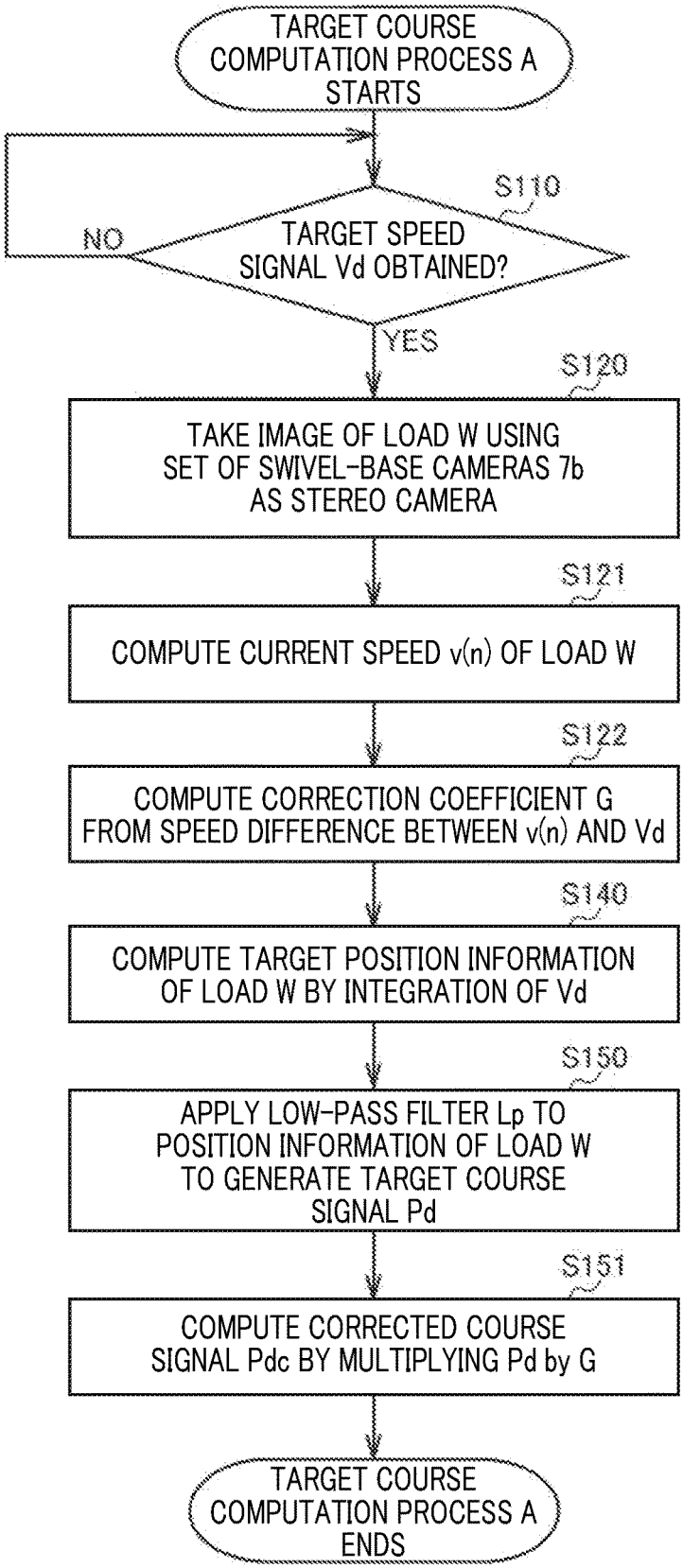
FIG. 15 is a flowchart illustrating a target-course computation process in which the target course signal is corrected.

As illustrated in FIG. 15, in step S120, boom position computation section 31*b* of control apparatus 31 causes an image of load W to be taken using the set of swivel-base cameras 7*a* on opposite, left and right, sides of the front of swivel base 7 as a stereo camera and makes the control proceed to step S121.

In step S121, boom position computation section 31*b* obtain current speed information of load W from the image taken by the set of swivel-base cameras 7*a* and computes current speed v(n) of load W, and makes the control proceed to step S122.

In step S122, target course computation section 31*a* of control apparatus 31 determines correction coefficient Gn according to a speed difference between computed current speed v(n) of load W and target speed signal Vd, and makes the control proceed to step S140.

Steps S140 and S150 are as described above.

In step S151, target course computation section 31*a* computes corrected course signal Pdc by multiplying computed target course signal Pd by correction coefficient Gn and ends target-course computation process A. and makes the control proceed to step S200 (see FIG. 9).

Crane 1 configured as described above measures current speed v(n) of load W using swivel-base cameras 7*a* and corrects target course signal Pd based on a speed difference between target speed signal Vd and current speed v(n), enabling reduction of an amount of gap between target course signal Pd and current position p(n) of load W. In this case, crane 1 corrects target course signal Pd in which frequencies that are equal to or higher than a predetermined frequency have been attenuated, enabling reducing an amount of shift from current position p(n) of load W while curbing swinging of load W with high accuracy.

Next, a method of calibration of a set of swivel-base cameras 7*a* used as a stereo camera will be described with reference to FIGS. 2 and 16.

As illustrated in FIG. 2, a set of swivel cameras 7*b* in crane 1 is provided with predetermined installation interval L1 therebetween. Also, in each of main hook block 10 and non-illustrated sub hook block 11 of crane 1), a set of markers 42 for calibration is provided with predetermined pitch L2.

Figure 16:
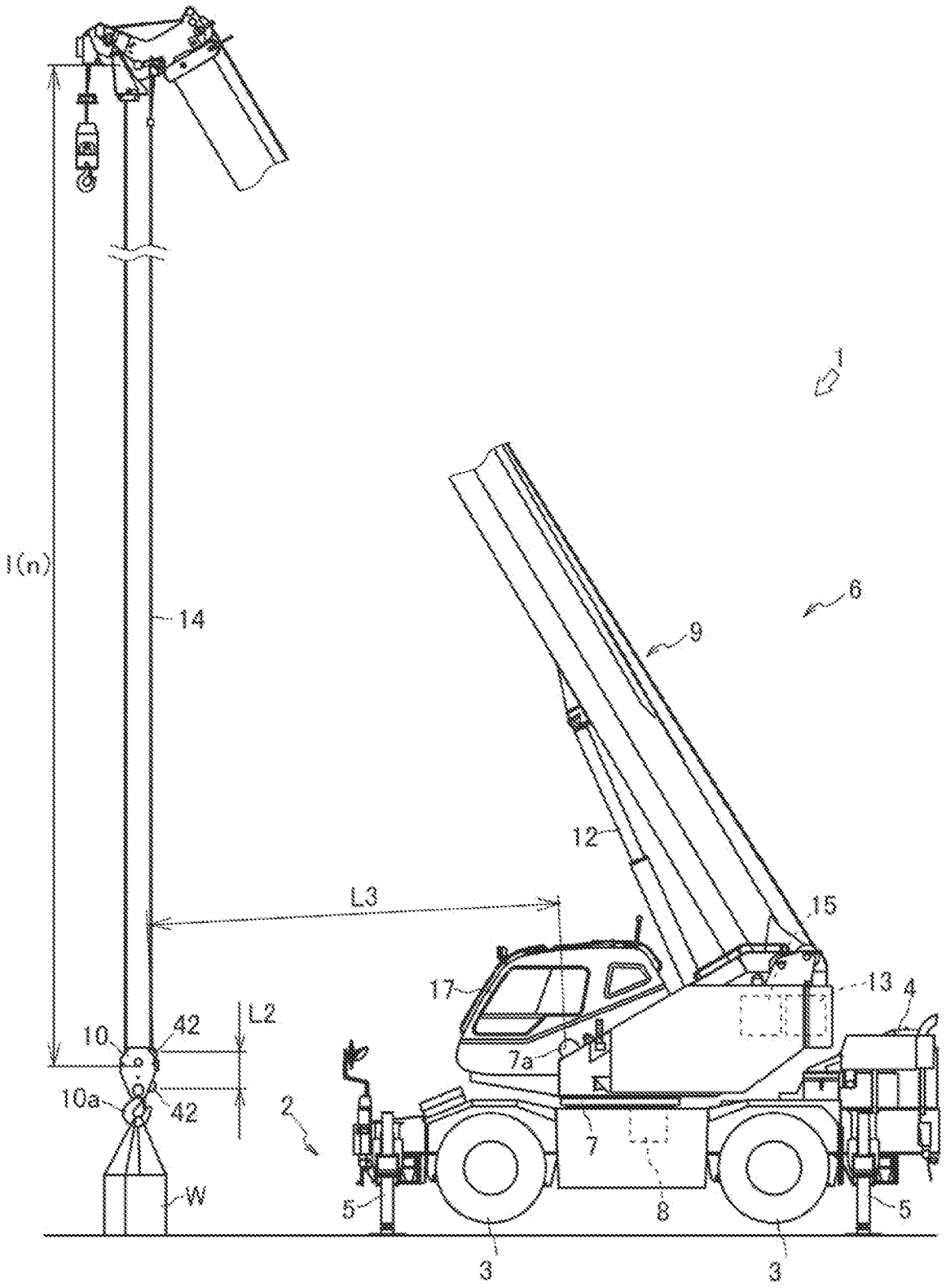
FIG. 16 is a schematic diagram illustrating a stereo camera calibration method.

As illustrated in FIG. 16, each marker 42 is a mark that is a reference for calibration. Each marker 42 is formed of an LED or fluorescent paint. During calibration work, crane 1 is controlled such that main hook block 10 is disposed in a vertical direction relative to the tip of boom 9. Control apparatus 31 of crane apparatus 6 computes distance L3 between main hook block 10 and swivel-base cameras 7*a* from current position coordinate q(n) of boom 9 with arbitrarily determined reference position O as an origin, positions at which swivel-base cameras 7*a* are provided and let-out amount l(n) of the wire rope. In other words, control apparatus 31 computes distance L3 from swivel-base cameras 7*a* to markers 42 using postural information of crane 1. Next, control apparatus 31 performs calibration based on installation interval L1 between the set of swivel cameras 7*b*, pitch L2 of the set of markers 42 and distance L3 to markers 42 so that a distance to load W, which is a subject, can be computed from a size of load W in an image.

As described above, in crane 1, calibration of swivel-base cameras 7*a* used as a stereo camera is automatically performed using current position coordinate q(n) of boom 9 and the positions at which swivel-base cameras 7*a* are provided and let-out amount l(n) of the wire rope. Crane 1 configured as described above can correctly compute distance L3, which is a spatial distance from swivel-base cameras 7*a* to main hook block 10 (load W), without using a measurement tool such as a laser rangefinder.

Each of the embodiments described above merely indicate a typical mode and can be variously modified and carried out without departing from the essence of an embodiment. Furthermore, it is needless to say that the present invention can be carried out in various modes, and the scope of the present invention is defined by the terms of the claims and includes any modifications within the scope and meaning equivalent to the terms of the claims.

INDUSTRIAL APPLICABILITY

The present invention is applicable to a crane including a monitoring apparatus.

REFERENCE SIGNS LIST

1 Crane
6 Crane apparatus
7*a* Swivel-base camera
9 Boom
O Reference position
Vd Target speed signal
p(n) Current position coordinate of load W
p(n+1) Target position coordinate of load W
q(n) Current position coordinate of boom
q(n+1) Target position coordinate of boom

The invention claimed is:

1. A crane comprising:

a crane apparatus;

a monitoring apparatus provided in the crane apparatus and configured to monitor a surrounding area and obtain positional information; and a control circuitry including a processor and configured to control an actuator of the crane apparatus based on a target speed signal relating to a moving direction and a speed of a load suspended by a wire rope from a boom of the crane apparatus, the target speed signal being input from a manipulation tool, wherein the control circuitry is configured to control the actuator of the crane apparatus by:

determining, based on the obtained positional information, a current position of the load and a target position of the load, computing, based on the determined current position of the load and target position of the load, a direction vector of the wire rope, computing, based on a let-out amount of the wire rope and the direction vector of the wire rope, a target position of a boom tip for the target position of the load, and generating an operation signal for the actuator of the crane apparatus, based on the target position of the boom tip, to control the actuator so as to move the load along a target course.

2. The crane according to claim 1, wherein:

the control circuitry is further configured to control the actuator of the crane apparatus by:

computing, based on the current position of the load and the obtained positional information, a current speed of the load, and computing a target course signal by integrating the target speed signal and attenuating a frequency component in a predetermined frequency range;

computing a speed difference between the target speed signal and the current speed;

computing a corrected course signal by multiplying the target course signal by a correction coefficient for reducing the speed difference; and converting the corrected course signal into the target position of the load relative to a reference position.

3. The crane according to claim 1, wherein the monitoring apparatus includes a plurality of cameras configured to take an image of the load as a stereo camera, and the control circuitry is further configured to determine, from the image taken by the plurality of cameras, the current position of the load relative to the reference position.

4. The crane according to claim 1, wherein the monitoring apparatus is configured to detect the load, and the control circuitry is further configured to control the actuator of the crane apparatus by:

computing, based on a position of the detected load, a current position of the load relative to a reference position, computing a current position of the boom tip relative to the reference position from a swivel angle, a luffing angle and an extension/retraction length of the boom, converting the target speed signal into a target position of the load relative to the reference position, and computing the let-out amount of the wire rope based on the current position of the load and the current position of the boom tip.

* * * * *